US009874029B2

(12) United States Patent
Kugler et al.

(10) Patent No.: US 9,874,029 B2
(45) Date of Patent: Jan. 23, 2018

(54) SUPPORT PLATE SYSTEM FOR ELEVATED FLOORING TILES

(71) Applicant: United Construction Products, Inc., Denver, CO (US)

(72) Inventors: William E. Kugler, Denver, CO (US); Stephen J. Knight, III, Littleton, CO (US)

(73) Assignee: United Construction Products, Inc., Denver, CO (US)

( * ) Notice: Subject to any disclaimer, the term of this patent is extended or adjusted under 35 U.S.C. 154(b) by 0 days.

(21) Appl. No.: 15/492,658

(22) Filed: Apr. 20, 2017

(65) Prior Publication Data

US 2017/0218640 A1 Aug. 3, 2017

Related U.S. Application Data

(63) Continuation of application No. 14/941,145, filed on Nov. 13, 2015, now abandoned.

(51) Int. Cl.
*E04F 15/024* (2006.01)

(52) U.S. Cl.
CPC .. *E04F 15/02452* (2013.01); *E04F 15/02494* (2013.01)

(58) Field of Classification Search
CPC ..... E04F 15/02494; E04F 15/02452; E04F 15/0247; E04F 15/02044; E04F 15/0215; E04F 15/02155
See application file for complete search history.

(56) References Cited

U.S. PATENT DOCUMENTS

| | | | | |
|---|---|---|---|---|
| 3,811,237 A * | 5/1974 | Bettinger | E04F 15/02452 52/126.6 |
| 4,085,557 A * | 4/1978 | Tharp | E04F 15/02441 52/126.6 |
| 4,319,520 A * | 3/1982 | Lanting | F24F 7/10 454/290 |
| 4,578,910 A | 4/1986 | Germeroth | |
| 4,637,181 A * | 1/1987 | Cohen | E04F 15/02452 52/126.5 |
| 4,719,727 A | 1/1988 | Cooper | |
| 4,833,845 A * | 5/1989 | Bruckner | E04F 15/02429 52/126.6 |
| 4,835,924 A | 6/1989 | Blacklin | |
| 4,850,163 A | 7/1989 | Kobayashi | |
| 4,905,437 A | 3/1990 | Heather | |
| 4,996,804 A * | 3/1991 | Naka | E04F 15/02482 52/126.1 |

(Continued)

FOREIGN PATENT DOCUMENTS

| | | |
|---|---|---|
| EP | 1509376 | 3/2010 |
| JP | 02311585 | 12/1990 |

(Continued)

*Primary Examiner* — Brent W Herring
(74) *Attorney, Agent, or Firm* — Marsh Fischmann & Breyfogle LLP; Jonathon A. Szumny

(57) ABSTRACT

An elevated flooring surface assembly including surface tiles disposed on respective support plates, the corners of which in turn rest on support pedestals disposed upon a fixed surface with a predetermined spacing therebetween to provide for increased degrees of support of the surface tiles above the fixed surface.

19 Claims, 15 Drawing Sheets

(56) References Cited

U.S. PATENT DOCUMENTS 5,048,242 A * 9/1991 Cline ..... E04F 15/02458 52/126.6
5,052,157 A 10/1991 Ducroux
5,333,423 A 8/1994 Propst
5,398,466 A 3/1995 Oyama
5,501,754 A 3/1996 Hiraguri
5,791,096 A 8/1998 Chen
5,904,015 A 5/1999 Chen
6,151,854 A 11/2000 Gutjahr
6,161,353 A 12/2000 Negola et al.
6,260,320 B1 7/2001 Di Lorenzo
6,370,831 B1 4/2002 Marshall
6,519,902 B1 2/2003 Scissom
6,550,195 B1 * 4/2003 Cooper ..... E04B 5/48 52/126.3
6,694,689 B1 * 2/2004 Scott ..... E04F 15/02 52/391
6,751,917 B2 6/2004 Mao
6,818,275 B2 11/2004 Guarda et al.
6,911,248 B2 6/2005 Sabatini
6,983,570 B2 1/2006 Mead
7,140,156 B1 11/2006 Lowe, Jr.
7,487,622 B2 * 2/2009 Wang ..... E04F 13/0862 52/177
7,536,835 B2 5/2009 Schluter
7,546,715 B2 * 6/2009 Roen ..... E04B 5/10 52/126.5
7,694,480 B2 4/2010 Niese
7,698,859 B2 4/2010 Sanso Marti
7,770,345 B2 * 8/2010 McConnell ..... E04F 15/02429 52/126.6
7,770,354 B2 8/2010 Bui
7,891,149 B2 2/2011 Turner et al.
7,918,059 B2 4/2011 Repasky
7,993,731 B2 8/2011 Miller et al.
8,002,943 B2 8/2011 Brown et al.
8,079,184 B2 12/2011 Wiercinski
8,112,947 B2 2/2012 Mead
8,146,319 B2 4/2012 McIntosh et al.
8,186,116 B2 5/2012 Anderson
8,192,823 B2 6/2012 Hainbach
8,302,356 B2 11/2012 Knight
8,381,461 B2 2/2013 Repasky
8,387,317 B2 * 3/2013 Kugler ..... E04F 15/02183 52/100
8,438,805 B2 5/2013 Repasky
8,557,083 B2 10/2013 Paganelli
8,631,624 B2 1/2014 McIntosh et al.
8,695,288 B2 * 4/2014 Kugler ..... E04F 15/02183 52/100
8,850,753 B2 10/2014 Tabibnia
8,881,482 B2 11/2014 Cerny
9,284,693 B2 3/2016 Tabibnia
9,683,375 B2 6/2017 Kugler
2002/0148173 A1 * 10/2002 Kugler ..... E04F 15/02183 52/126.6
2003/0089049 A1 * 5/2003 Scissom ..... E04F 15/02452 52/126.1
2003/0097808 A1 * 5/2003 Sabatini ..... E04F 15/02423 52/386
2004/0035064 A1 2/2004 Kugler
2004/0172899 A1 9/2004 Paradise
2004/0261329 A1 * 12/2004 Kugler ..... E04F 15/02183 52/126.6
2005/0166483 A1 8/2005 Mead
2006/0260223 A1 * 11/2006 Wang ..... E04F 13/0862 52/177
2007/0044397 A1 3/2007 Wiercinski
2008/0289289 A1 11/2008 Wiercinski
2009/0183442 A1 7/2009 Repasky
2010/0257801 A1 * 10/2010 Anderson ..... E01C 5/001 52/391
2011/0016809 A1 * 1/2011 Knight, III ..... E04D 11/007 52/263
2011/0146200 A1 6/2011 Dang
2011/0214798 A1 9/2011 Tracy
2012/0272588 A1 * 11/2012 Kugler ..... E04F 15/02183 52/126.6
2012/0272589 A1 * 11/2012 Kugler ..... E04F 15/02183 52/126.6
2014/0308076 A1 10/2014 Tabibnia
2015/0184398 A1 * 7/2015 Tabibnia ..... E01C 5/00 52/105
2016/0040439 A1 * 2/2016 Pelc ..... E04F 15/02452 52/126.6
2016/0244979 A1 8/2016 Greaves

FOREIGN PATENT DOCUMENTS

JP 5561966 7/2014
JP 2014227720 8/2014
WO 2007099572 9/2007

* cited by examiner

SUPPORT PLATE SYSTEM FOR ELEVATED FLOORING TILES

CROSS REFERENCE TO RELATED APPLICATIONS

This application is a continuation of U.S. patent application Ser. No. 14/941,145, entitled "SUPPORT PLATE SYSTEM FOR ELEVATED FLOORING TILES," and filed on Nov. 11, 2015, the entire contents of which is incorporated herein in its entirety as if set forth in full.

BACKGROUND OF THE INVENTION

1. Field of the Invention

This invention relates to the field of structural systems for elevating surface materials such as for elevated floors, decks and walkways.

2. Description of Related Art

Elevated building surfaces such as elevated floors, decks, terraces and walkways are desirable in many interior and exterior environments. One common system for creating such surfaces includes a plurality of surface tiles, such as concrete tiles (pavers), stone tiles, clay tiles, ceramic tiles, or wood tiles, and a plurality of spaced-apart support pedestals and/or joists or stringers upon which the tiles are placed to be supported above a fixed surface. For example, in outdoor applications, the surface may be elevated above a fixed surface to promote drainage, to provide a level structural surface for walking, and/or to prevent deterioration of or damage to the surface tiles.

Various shapes of surface tiles are possible. In the case of rectangular-shaped tiles, for instance, each of the spaced-apart support pedestals can support four adjacent surface tiles at the tile corners. Stated another way, each rectangular surface tile can be supported by four pedestals that are disposed under each of the corners of the tile.

The pedestals can have a fixed height or can have an adjustable height such as to accommodate variations in the contour of the fixed surface upon which the pedestals are placed or to create desirable architectural features. Various types of support pedestals are disclosed in U.S. Pat. No. 6,363,685 to Kugler, U.S. Patent Publication No. 2004/0261329 to Kugler et al., U.S. Pat. No. 8,122,612 to Knight, III et al., and U.S. Pat. No. 8,898,999 to Kugler et al., each of which is incorporated herein by reference in its entirety. For instance, some types of support pedestals include a threaded base member and a threaded support member that is threadably engaged with the base member to enable the height of the support pedestal to be adjusted by rotating the support member or the base member relative to the other. Support pedestals can also include an extender member (e.g., a coupling or coupler member) disposed between the base member and the support member for further increasing the height of the pedestal, if necessary.

SUMMARY OF THE INVENTION

In one aspect disclosed herein, an elevated flooring surface assembly includes a plurality of support pedestals disposed upon a fixed surface with a predetermined spacing between the support pedestals, a plurality of support plates disposed over top surfaces of the plurality of support pedestals, and a plurality of surface tiles respectively positioned over the plurality of support plates. Each support plate includes a base having a top surface, a bottom surface opposite to the top surface, a plurality of corner portions, a plurality of outer edge segments disposed between adjacent corner portions, and a locating structure attached to a first of the outer edge segments and extending away from the top surface, where a second of the outer edge segments of each support plate is free of locating structures extending away from the top surface, and where each support plate includes at least three corner portions that are respectively disposed over the top surfaces of at least three of the support pedestals. Each surface tile includes a top surface, a bottom surface opposite to the top surface, a plurality of corner portions, and a plurality of outer edge segments disposed between adjacent corner portions, where one of the outer edge segments of each surface tile abuts the locating structure of the first outer edge segment of its respective support plate.

In one embodiment, a locating structure may be attached to a third outer edge segment of each support plate and that extends away from the top surface so that a second outer edge segment of the surface tile can abut the locating structure of the third outer edge segment of the support plate. For instance, the first outer edge segment of the support plate may be opposite or adjacent the third outer edge segment of the support plate.

In another embodiment, at least one of the corner portions of each support plate may be attached to the top surface of the respective support pedestal. For instance, the at least one of the corner portions of each support plate may be mechanically affixed to the top surface of the respective support pedestal, such as with a washer being positioned over the at least one of the corner portions of each support plate and a fastener extending through the washer and into the top surface of the support pedestal.

In one arrangement, the bottom surface of each support tile may be bonded to the top surface of one of the support plates with at least one adhesive. The adhesive may be any appropriate organic or inorganic adhesive. In one embodiment, the at least one adhesive may be one or more strips of adhesive such as single-sided or double-sided adhesive strips.

In another aspect, a method of constructing an elevated flooring surface is disclosed that includes locating a plurality of support pedestals upon a fixed surface with a predetermined spacing between the support pedestals, placing (e.g., before or after the locating step) support plates over top surfaces of the plurality of support pedestals, and positioning each of a plurality of surface tiles over a respective one of the support plates so that one of a plurality of outer edge segments of the surface tile abuts a locating structure of a first outer edge segment of the support plate. Each support plate includes a base having a top surface, a bottom surface opposite to the top surface, a plurality of corner portions, and a plurality of outer edge segments disposed between adjacent corner portions, where a first of the outer edge segments of each support plate includes a locating structure extending away from the top surface, where a second of the outer edge segments of each support plate is free of locating structures extending away from the top surface, and where each support plate includes at least three corner portions that are respectively disposed over the top surfaces of at least three of the support pedestals. Furthermore, each surface tile includes a top surface, a bottom surface opposite to the top surface, and a plurality of corner portions, where each outer edge segment of each support tile is disposed between adjacent corner portions of the surface tile, where at least one adhesive secures the bottom surface of each surface tile to the top surface of the one of the support plates, and where the top surfaces of the surface tiles collectively form the elevated flooring surface over the fixed surface.

In one embodiment, the method may further include disposing (e.g., placing, applying, etc.) the at least one adhesive onto the top surfaces of the support plates and/or onto the bottom surface of each of the plurality of surface tiles (e.g., before or after the step of placing the support plates on the pedestals) to bond or secure the bottom surface of the surface tiles to the top surface of the support plates. As an example, the at least one adhesive may be in at least a semi-solid or substantially solid state during the disposing step. For instance, the adhesive may be in the form of one or more strips of adhesive of any appropriate material (e.g., butyl rubber, as just one example) and of any appropriate dimensions (e.g., width, length, thickness) to cover at least a portion of the surface area of the top surfaces of the support plates and/or the bottom surface of each of the plurality of surface tiles so as to secure the surface tiles to the support plates. As one example, the at least one adhesive may cover at least about 5% of such surface area. As another example, the at least one adhesive may cover not more than about 90% of such surface area). As a further example, the at least one adhesive may cover an entirety of such surface area. Other arrangements are also envisioned.

As another example, the at least one adhesive may be in a fluid state during the applying step and then be allowed to solidify after the surface tile is placed over the support plate to secure the surface tile to the support plate such as through drying, heat, cooling, and/or the like.

The at least one adhesive may in the nature of any appropriate organic or inorganic adhesive. In one arrangement, the adhesive may be in the form of any appropriate non-reactive adhesive such as a drying-type adhesive. For instance, the adhesive may be a solvent-based adhesive (e.g., mixture of polymers dissolved in any appropriate solvent) where the adhesive hardens or solidifies as the solvent evaporates to secure the surface tiles to the support plates (e.g., such that the adhesive is substantially free of solvents after the adhesive has solidified). As another example, the adhesive may be in the form of a water-based (waterborne) adhesives, such as formulated from natural or synthetic polymers. As a further example, the adhesive may be a hot adhesive (e.g., hot melt adhesive) such as a thermoplastic applied in molten form which solidifies on cooling to bond the surface tiles to the support plates. As a still further example, the adhesive may be in the form of a reactive adhesive such as a one-part adhesive that hardens via a chemical reaction with an external energy source (e.g., radiation, heat, moisture), a multi-component or part adhesive that hardens by mixing together two or more components that chemically react, or the like. In addition to the exemplary aspects and embodiments described above, further aspects and embodiments will become apparent by reference to the drawings and by study of the following descriptions.

DETAILED DESCRIPTION

Figure 1:
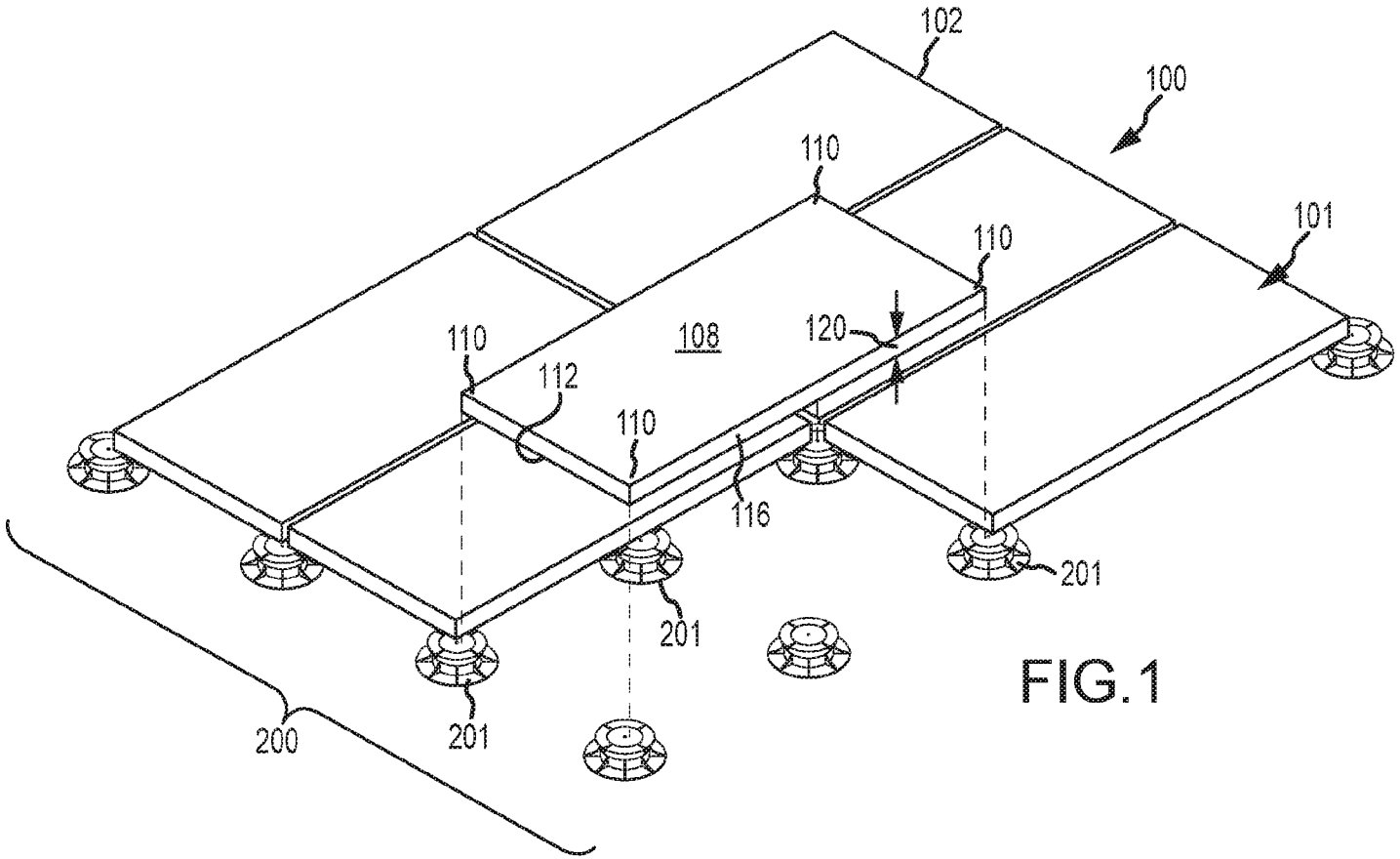
FIG. 1 is a perspective view of an interior or exterior building surface assembly.

FIG. 1 illustrates a portion of an elevated building surface assembly 100 that includes a building surface 101 formed from a plurality of building surface components 102 (e.g., surface tiles, pavers, flooring units, etc.) that are elevated above a fixed surface by a support structure 200 made up of a plurality of spaced-apart support members such as support pedestals 201. Each building surface component 102 may broadly include opposing top and bottom surfaces 108, 112, one or more corner portions 110, one or more outer edge segments 116 disposed between adjacent corner portions 110, and a thickness 120 between the top and bottom surfaces 108, 112. The building surface components 102 may take various shapes (e.g., rectangular as shown, square, hexagonal, and/or other shapes) and may be made from virtually any material from which a building surface is to be constructed. Examples include, but are not limited to, slate, stone, porcelain, ceramic, cement compounds, concrete, wood, metal, fiberglass, plastic, composites, combinations of the foregoing, and the like.

The support pedestals 201 can be placed in a spaced-apart relation on fixed surfaces including, but not limited to, rooftops, plazas, over concrete slabs including cracked or uneven concrete slabs or sub-floors and can be placed within fountains and water features and the like. The elevated building surface assembly 100 can be used for both interior and exterior applications. For instance, the bottom surfaces 112 of the corner portions 110 of each building surface component 102 may be placed upon several support pedestals 201 to elevate the building surface component 102 above the fixed surface. As illustrated in FIG. 1, some support pedestals 201 may be disposed beneath four corner portions 110 of adjacent building surface components 102 while other support pedestals 201 may be disposed under the outer edge segments 116 of the building surface components 102 (e.g., between the corner portions 110 and proximate to a central portion of the outer edge segment 116). Such a configuration may be desirable when using very heavy and/or very large building surface components, such as large concrete building surface components, when placing heavy objects on the elevated building surface (e.g., planters, benches, etc.), or the like. Although not illustrated, support pedestals 201 may be disposed in other locations, such as below a central portion of the building surface components 102.

The support pedestals 201 forming the support structure 200 may be height-adjustable, fixed height, or any combination thereof and may be constructed of any appropriate materials (e.g., metals, plastics, carbon fibers, composites, etc.). Broadly, each support pedestal 201 may include a lower portion that is adapted to be placed upon a fixed surface, an upper portion for receiving a building surface component 102, and a central section extending between or otherwise interconnecting (e.g., perpendicularly) the upper and lower portions. The support pedestals 201 may be laid out in various configurations as may be dictated by the shape and size of the building surface components, such as a rectangular configuration or a triangular configuration to support rectangular or triangular building surface components.

Figure 2:
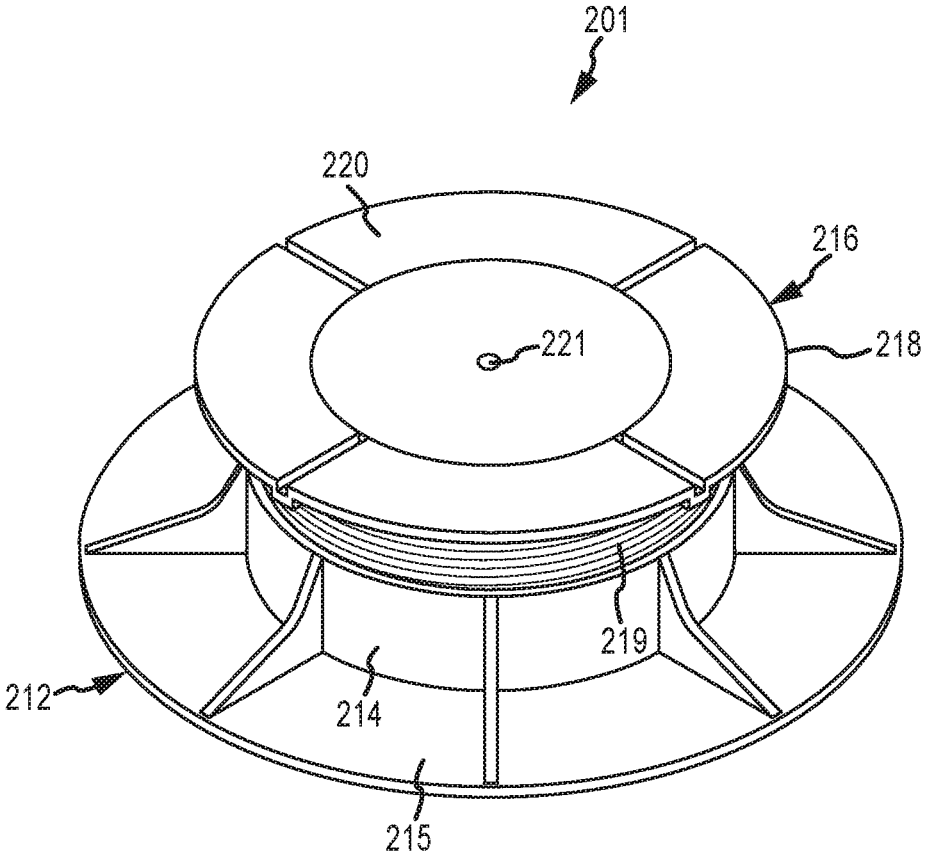
FIG. 2 is a perspective view of a support pedestal for use with the surface assembly of FIG. 1.

Turning now to FIG. 2, a support pedestal 201 (e.g., one or more of support pedestals 201 of FIG. 1) for supporting building surface components (e.g., building surface components 101 of FIG. 1) of an elevated building surface assembly (e.g., elevated building surface assembly 100 of FIG. 1) according to one embodiment is shown. Broadly, the support pedestal 201 may include a lower portion such as a base member 212 including a base plate 215 that is configured to be placed against a fixed surface (e.g., ground, rooftop, etc.) and a base extension 214 connected to the base plate 215 in any appropriate manner and extending away from the base plate 215. The support pedestal 300 may also include an upper portion such as a support member 216 including a support plate 218 having an upper or top surface 220 over which building surface components 102 are configured to be placed and support extension 219 connected to the support plate 218 in any appropriate manner and extending away from the support plate 218.

As shown in FIG. 2, the base and support extensions 214, 219 may be threadably engageable with each other to allow the height of the support pedestals 201 (i.e., the distance between the base and support plates 215, 218) to be adjusted. For instance, the base extension 214 may be in the form of a hollow cylindrical member having a threaded inner surface and the support extension 219 may be in the form of a cylindrical member having a threaded outer surface that is configured to be threadably received inside the base extension 214 (or vice versa). The base and support extensions 214, 219 may collectively form a "central section" of the support pedestal 201. In some arrangements, one or more coupling members may be incorporated between the base and support extensions 214, 219 to allow for increased heights of the support pedestal 201 (e.g., such as that disclosed in U.S. Pat. No. 8,156,694 which is incorporated herein by reference as if set forth in full). In other arrangements, the support pedestal 201 may have a fixed height, such as where the base and support plates 215, 218 are fixedly attached together by one or more rigid members that are not adjustable relative to each other.

Figure 3:
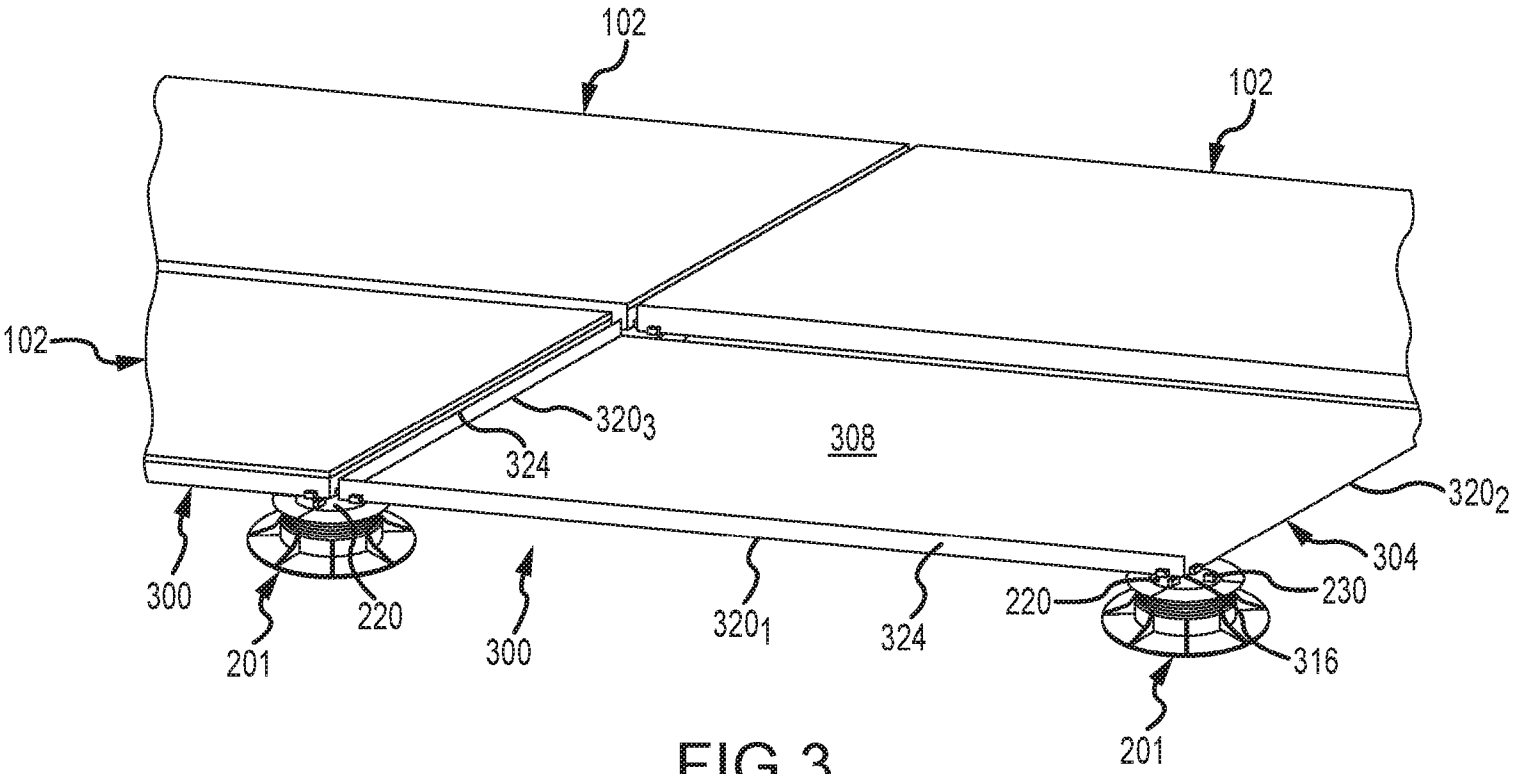
FIG. 3 is a perspective view of the surface assembly of FIG. 1 and illustrating a support plate for supporting a building surface component of the surface assembly.
Figure 4:
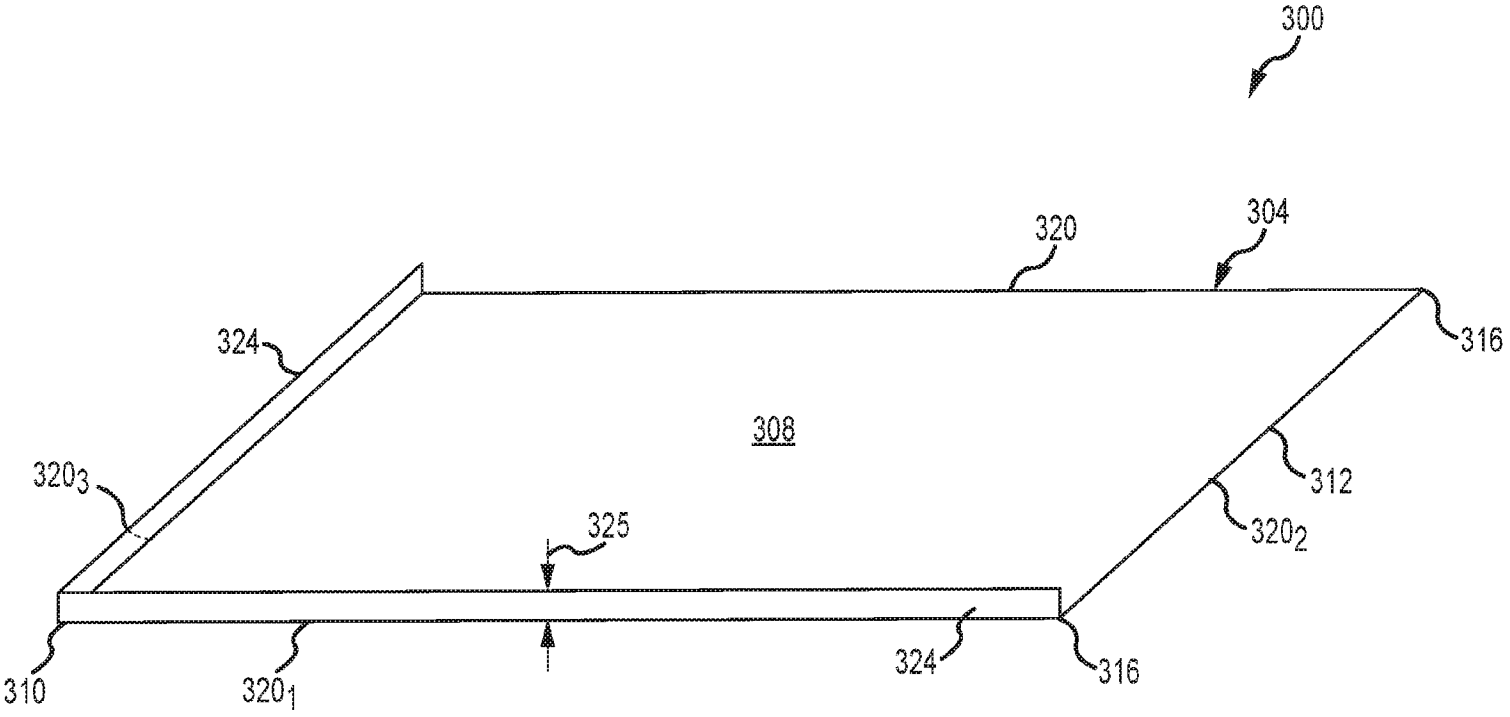
FIG. 4 is a perspective view of the support plate of FIG. 3.

With reference now to FIGS. 3-4, one embodiment of a support plate 300 is illustrated that is configured to provide additional support for the building surface components 102 of the elevated building surface assembly 100, reduce the potential for dropping or falling of the building surface components 102 or portions thereof in case of fracture or cracking of the building surface components 102 (e.g., towards or to the fixed surface), facilitate proper location of the building surface components 102 over the support pedestals 201 to create the building surface 101, and increase the overall durability of the elevated building surface assembly 100. Broadly, the support plate 300 may include a body or base 304 with opposite top and bottom surfaces 308, 312, a plurality of corners or corner portions 316, and a plurality of outer edge segments 320 between adjacent corner portions 316 and generally forming an outer perimeter of the support plate 300. The base 304 may generally be in the form of a planar member that serves as a barrier between a building surface component 102 laid over the top surface 308 of the base 304 and the fixed surface below the building surface components 102 and that serves to inhibit movement of the building surface component 102 (or portions thereof) downwardly in a direction towards or to the fixed surface. In one arrangement, the base 304 may be free of or substantially free of any apertures therethrough between the top and bottom surfaces 308, 312 (e.g., to reduce the likelihood of passage of one or more portions of a building surface component 102 therethrough). The base 304 may be made of any appropriate material such as metal, plastic, wood, a cement-compound, concrete, clay, fiberglass, rubber, a composite material, one or more combinations of any of the aforementioned, or the like.

At least one locating structure 324 may be attached or otherwise connected to at least a first outer edge segment $\mathbf{320}_1$ of the support plate 300 and may extend in a direction away from the top surface 308 of the support plate 300, such as in an upward direction away from the bottom surface 312. The locating structure 324 is broadly configured to abut (e.g., contact) a corresponding outer edge segment 116 of a building surface component 102 (e.g., see FIGS. 6-7, discussed below) to inhibit movement of the building surface component 102 in a direction towards the locating structure 324 and in a plane that is generally parallel to a plane in which the upper surface 308 of the base 304 resides. A height 325 of the locating structure 324 (i.e., a distance from the top surface 308 to an upper free end of the locating structure 324) may be configured to be the same as or less than the thickness 120 of the building surface component 102 so that the locating structure 324 may be concealed between substantially abutting outer edge segments 116 of adjacent building surface components 102. Stated differently, the top surface 308 of the building surface component 102 may be positioned above the upper free end of the locating structure 324.

As an example, the locating structure 324 may be in the form of at least one wall (e.g., lip, rib) that extends away from the upper surface 308 (e.g., at 90° or at any other appropriate angle) along at least a portion of the length of the first outer edge segment $\mathbf{320}_1$ between adjacent corresponding corner portions 316 (e.g. either the entire length as shown in FIGS. 3-4 or less than the entire length). For instance, the wall may be a portion of the base 304 that is deformed upwardly or otherwise upturned so as to extend away from the top surface 308. Alternatively, the wall may be a separate member that is connected to the base 304 adjacent the first outer edge segment $320_1$ in any appropriate manner (e.g., welding or the like). However, the locating structure 324 may take various other forms such as tabs, pins, clips, rails or the like.

As shown in FIGS. 3-4, at least a second outer edge segment $320_2$ of the support plate 300 is free of locating structures 324 thereon. That is, the second edge segment $320_2$ is free of locating structures 324 thereon such that a building surface component 102 disposed over the top surface 308 of the base 304 would not be inhibited from sliding or otherwise moving in a direction towards the second outer edge segment $320_2$ and in a plane that is generally parallel to the plane in which the upper surface 308 of the base 304 resides (i.e., in the absence of other components, materials, etc. that would tend to inhibit such movement such as at least one adhesive between the bottom surface 112 of the building surface component 102 and the top surface 308 of the base 304 (discussed below), a locating tab 230 extending from an upper surface 220 of a support pedestal 201, an adjacent building surface component 102, etc.). Among other advantages, this feature simplifies manufacture of the support plate 300, facilitates placement or location of a building surface component 102 over the top surface 308 of the support plate 300, allows for receipt of different sizes (e.g., widths, lengths) of building surface component 102, and the like.

Figure 13:
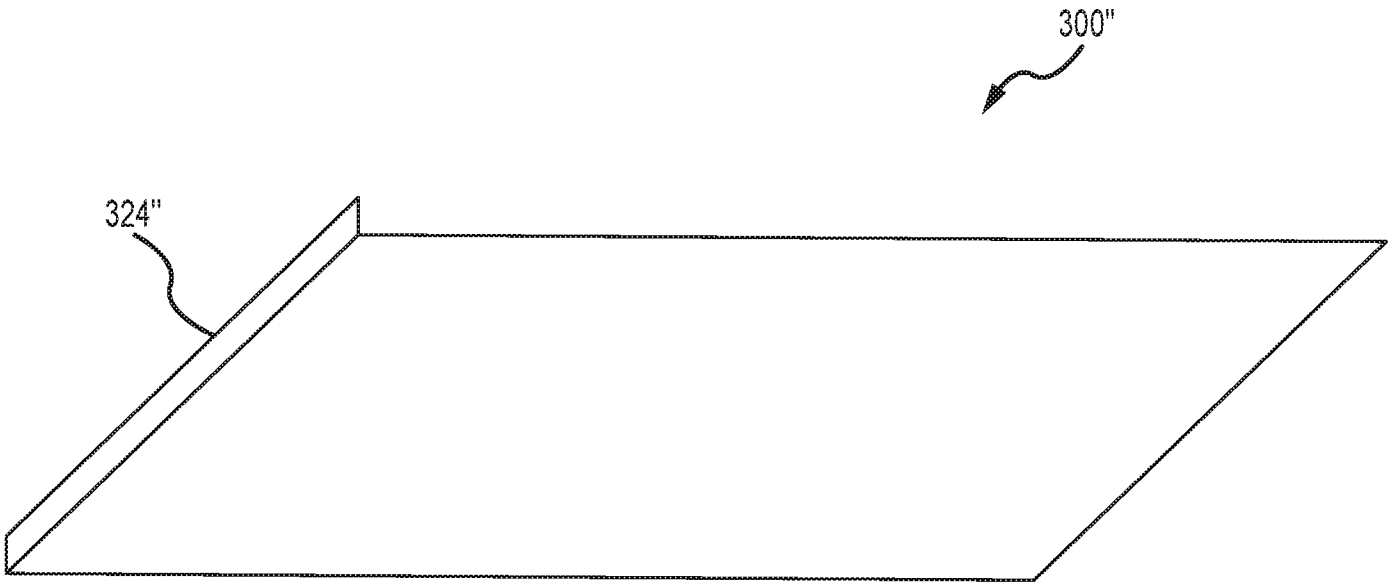
FIG. 13 is a perspective view of another embodiment of the support plate.

In one arrangement, another locating structure 324 may be attached or otherwise connected to a third outer edge segment $320_3$ of the support plate 300 and may extend in a direction away from the top surface 308 of the support plate 300, such as in an upward direction away from the bottom surface 312. As shown in FIGS. 3-4, for instance, the first and third outer edge segments $320_1$, $320_3$ may be adjacent to each other (i.e., they may share a common corner portion 316 of the support plate 300). This arrangement may facilitate location of a building surface component 102 over the top surface 308 of the support plate 300 by, for instance, allowing an installer to urge a corner portion 110 of a building surface component 102 into the corner portion 316 of the support plate 300 between the adjacent first and third outer edge segments $320_1$, $320_3$ until the corner portion 110 abuts the corner portion 316 or is seated adjacent or over the corner portion 316. In another arrangement, the first and third outer edge segments $320_1$, $320_3$ may be opposite each other (e.g., parallel to each other) and not share any common corner portions 316 of the support plate. In a further arrangement, the support plate 300 may include only a single locating structure such as the locating structure 324" in the support plate 300" of FIG. 13.

To facilitate the reader's understanding of how support plates 300 may be incorporated and used within an elevated building surface assembly 100, various methods of constructing an elevated building surface assembly 100 at a particular site of interest will now be discussed. As initially shown in FIGS. 1 and 3, a plurality of support pedestals 201 may be located or placed upon a fixed surface (e.g., ground, rooftop, etc.) at the site with any appropriate (e.g. predetermined) spacing between the support pedestals 201. For instance, any appropriate number of fixed and/or adjustable-height support pedestals 201 may be used and may be selected or configured so that the upper surfaces 220 of at least some adjacent ones of the support pedestals 201 are substantially coplanar. As one example, the upper surfaces 220 of all of the support pedestals 201 may be coplanar. As another example, however, the elevated building surface assembly 100 may be constructed so that the building surface 101 has two or more portions (e.g., levels) at different heights relative to a fixed reference plane that is parallel to surfaces of the multiple levels. Thus, in another arrangement, the upper surfaces 220 of a first group of adjacent support pedestals 201 may reside in a first plane while the upper surfaces 220 of a second group of adjacent support pedestals 201 may reside in a second plane, where the first and second planes are at different heights from a fixed third reference plane that is parallel to the first and second planes.

Figure 9:
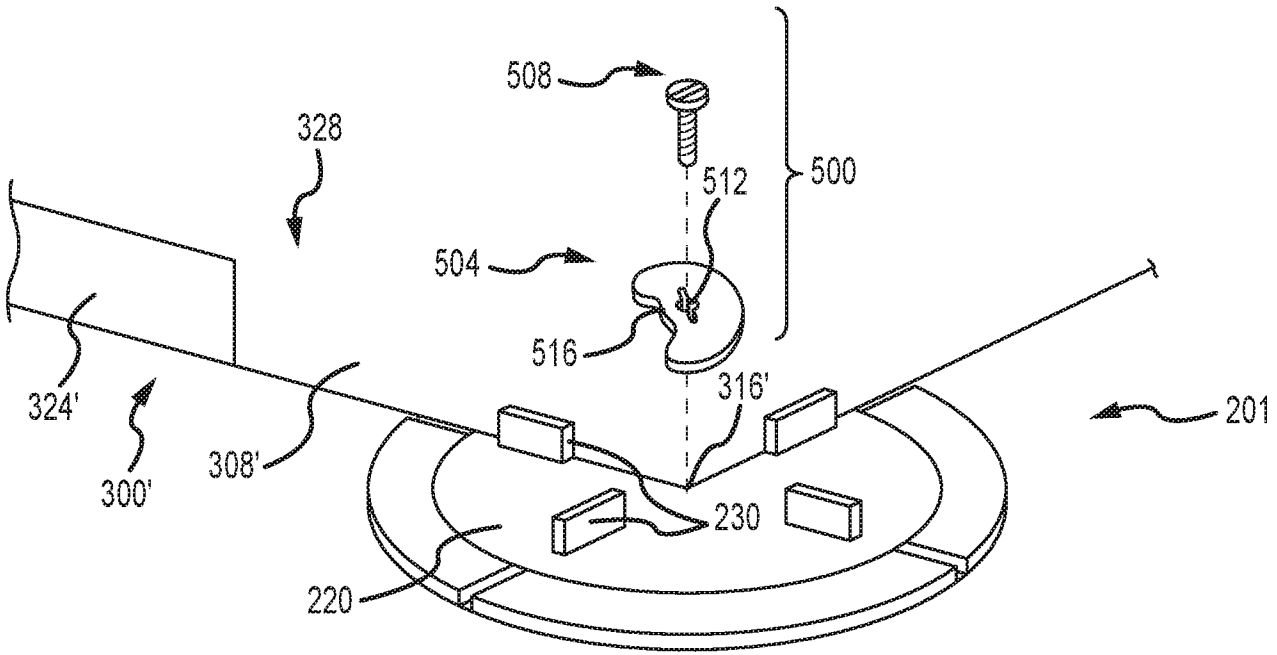
FIG. 9 is a close-up view a corner of the support plate of FIG. 8 and illustrating a securement apparatus exploded from the corner of the support plate for securing the corner of the support plate to the upper surface of a support pedestal of the surface assembly.
Figure 10:
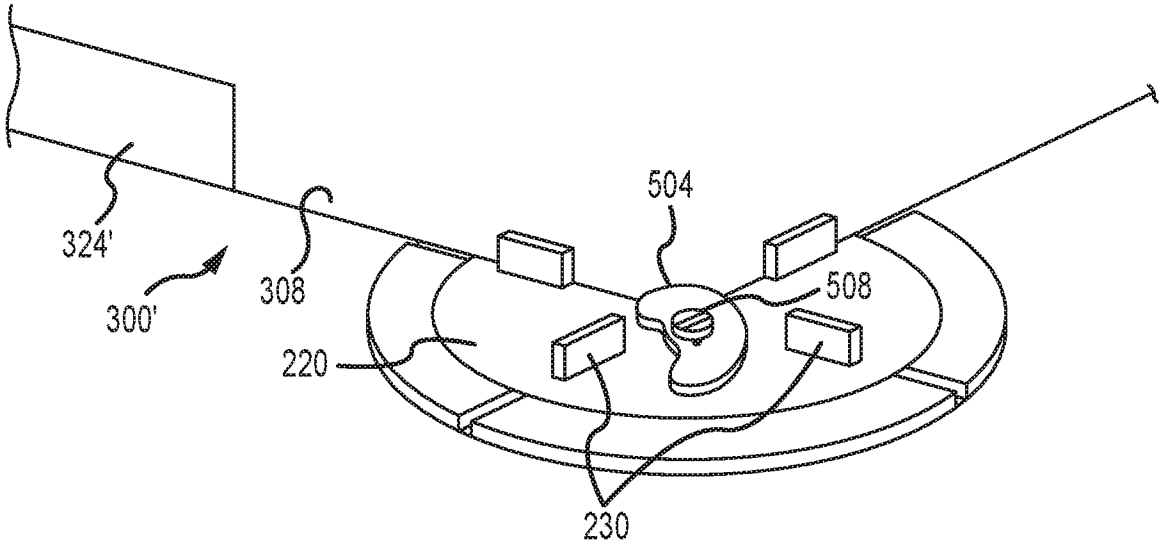
FIG. 10 is similar to FIG. 9 but with the securement apparatus attached to the upper surface of a support pedestal to secure the corner of the support plate to the support pedestal.

In any case, one or more support plates 300 may be appropriately placed over the top surfaces 220 of a plurality of the support pedestals 201, such as by placing the bottom surface 312 of each support plate 300 adjacent corner portions 316 onto or over the upper surfaces 220 of different respective adjacent support pedestals 201 as shown in FIG. 3. For a support plate 300 having four corner portions 316, for instance, the four corner portions 316 may be placed over four respective adjacent support pedestals. However, support plates 300 having fewer than four corner portions (e.g., three corner portions) or more than four corner portions (e.g., five, six, etc.) are also encompassed in the present disclosure. In some cases, the upper surface 220 each support pedestal 201 may support corner portions 316 from two or more support plates 300. In the case where the support pedestals 201 include spacer tabs 230 or the like extending from the upper surface 220 for spacing adjacent building surface components 102, the corner portions 316 of the support plate 300 may be urged or placed between adjacent pairs of spacer tabs 230 on the upper surface 220 of the support pedestal 201. In some arrangements, each support plate 300 may be secured in any appropriate manner to the support pedestals 201 (one representative manner being discussed below in relation to FIGS. 9-10).

The method may then include positioning a building surface component 102 over and/or on each respective support plate 300 so that one of the outer edge segments 116 of the building surface component 102 abuts (e.g., full contact, near contact, etc.) the locating structure 324 of the first outer edge segment $320_1$ of the support plate 300. Compare building surface component 102 and support plate 300 in FIGS. 6-7. More particularly, the bottom surface 112 of the building surface component 102 may be laid over the top surface 308 of the support plate 300 so that the corner portions 110 of the building surface component 102 are generally adjacent (e.g., above) the corner portions 316 of the support plate 300. Furthermore, the corner portions 110 of the building surface component 102 may be supported by the upper surfaces 220 of the support pedestals 201. With respect to the embodiment of the support plate 300 of FIGS. 3-7, another outer edge segment 116 of the building surface component 102 may abut the locating structure 324 of the third outer edge segment $320_3$ of the support plate 300.

The building surface components 102 may be positioned over the support plates 300 at the site after the support plates 300 have already been positioned over the support pedestals 201. Stated differently, in contrast to positioning the building surface components 102 on the support plates 300 at a manufacturing facility or the like and then transporting each building surface component 102/support plate 300 unit to the site at which the elevated flooring surface is being built, the building surface components 102 and support plates 300 may be separately transported to the site (e.g., whether as part of the same or different shipments) and then building surface components 102 may be positioned over the support plates 300 at the site (after the support plates 300 have already been positioned over the support pedestals 201).

Figure 7:
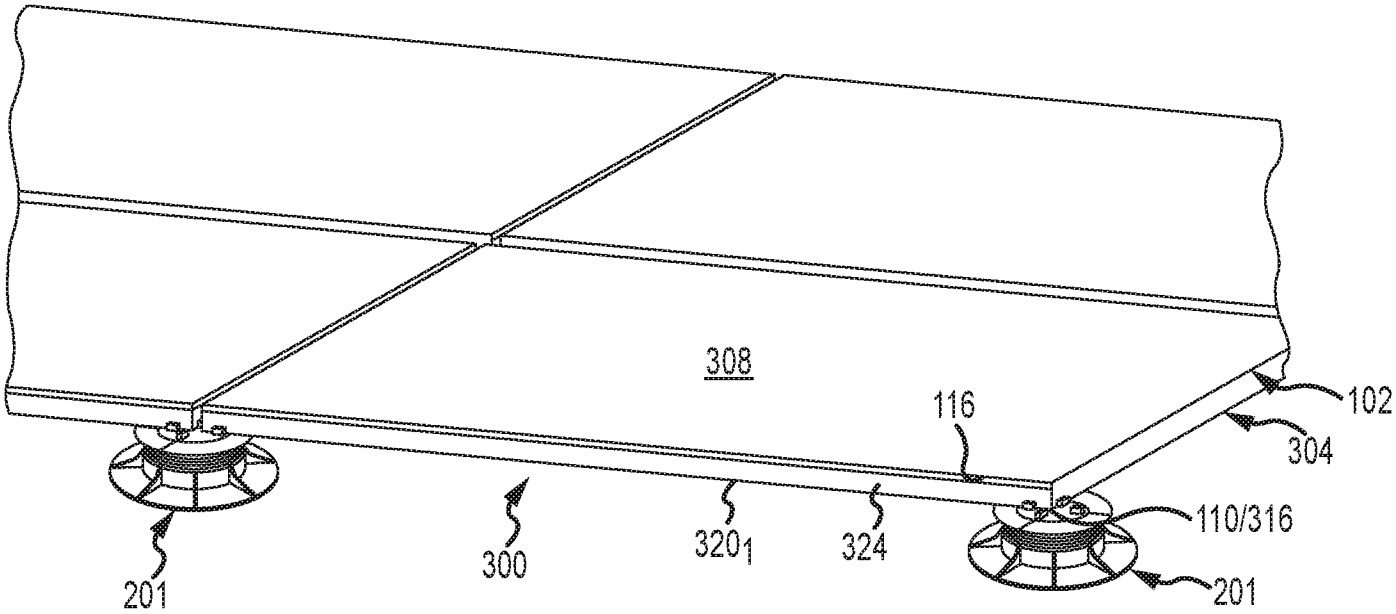
FIG. 7 is similar to FIG. 6 but illustrating the building surface component being positioned onto the one or more adhesive strips to secure the building surface component to the upper surface of the support plate.

In any case, once the building surface component 102 is laid over base 304 of the support plate 300 as shown in FIG. 7, it is noted how the upper surface 308 of the building surface component 102 may be positioned above the locating structures 324 of the first and third outer edge segments $\mathbf{320}_1$, $\mathbf{320}_3$ to conceal the locating structures 324 for safety and aesthetical purposes. At this point, each support plate 300 may serve to provide additional support for the building surface component 102 laid thereover, reduce the likelihood of dropping or falling of the building surface component 102 or portions thereof in case of fracture or cracking of the building surface components 102 (e.g., towards or to the fixed surface), increase the overall durability of the elevated building surface assembly 100, and the like.

In one arrangement, at least one adhesive 400 may be disposed (e.g., applied, placed, etc.) onto the top surfaces 308 of the support plates 300 and/or onto the bottom surfaces 112 of the building surface components 102 and then the building surface components 102 may be placed over the support plates 300 so that the at least one adhesive 400 secures or bonds the building surface components 102 to the support plates 300 and thereby further increases the overall durability of the elevated building surface assembly 100 and the like. Compare FIGS. 3, 5 and 6. In one embodiment, the at least one adhesive may be in at least a semi-solid or substantially solid state during the disposing step. For instance, the at least one adhesive may be in the form of one or more adhesive strips 400 (e.g., where each of opposing first and second surfaces of the adhesive strips 400 are adhesive or tacky) of any appropriate material (e.g., butyl rubber, as just one example) and of any appropriate dimensions (e.g., width, length, thickness) to cover at least a portion of the surface area of the top surface 308 of the support plate 300 and/or the bottom surface 112 of the building surface component 102 (e.g., at least about 5% of the surface area; not greater than about 90% of the surface area; etc.). It is noted that the thickness of the strips 400 in FIGS. 5-6 has been exaggerated relative to other illustrated components to assist the reader in understanding the present disclosure.

As another example, the at least one adhesive 400 may be in a fluid state when it is applied to the top surface 308 of the support plate 300 and/or the bottom surface 112 of the building surface component 102 and then be allowed to solidify (e.g., through drying, heat, cooling, etc.) after the building surface component 102 is placed onto the support plate 300 to secure the building surface component 102 to the support plate 300. In one arrangement, the at least one adhesive 400 may include any appropriate organic or inorganic adhesive. As one example, the at least one adhesive 400 may be in the nature of a non-reactive adhesive such as a drying-type adhesive. For instance, the at least one adhesive 400 may be a solvent-based adhesive (e.g. mixture of polymers dissolved in a solvent) where the adhesive hardens or solidifies as the solvent evaporates to secure the surface tiles to the support plates (e.g., such that the adhesive is substantially free of solvents after the adhesive has solidified). As another example, the adhesive may be in the form of a water-based (waterborne) adhesives, such as formulated from natural or synthetic polymers. As a further example, the at least one adhesive 400 may be a hot adhesive (e.g., hot melt adhesive) such as a thermoplastic applied in molten form which solidifies on cooling to bond the building surface components 102 to the support plates 300. As a still further example, the at least one adhesive 400 may be in the form of a reactive adhesive such as a one-part adhesive that hardens via a chemical reaction with an external energy source (e.g., radiation, heat, moisture), a multi-component or part adhesive that hardens by mixing together two or more components that chemically react, or the like.

Figure 5:
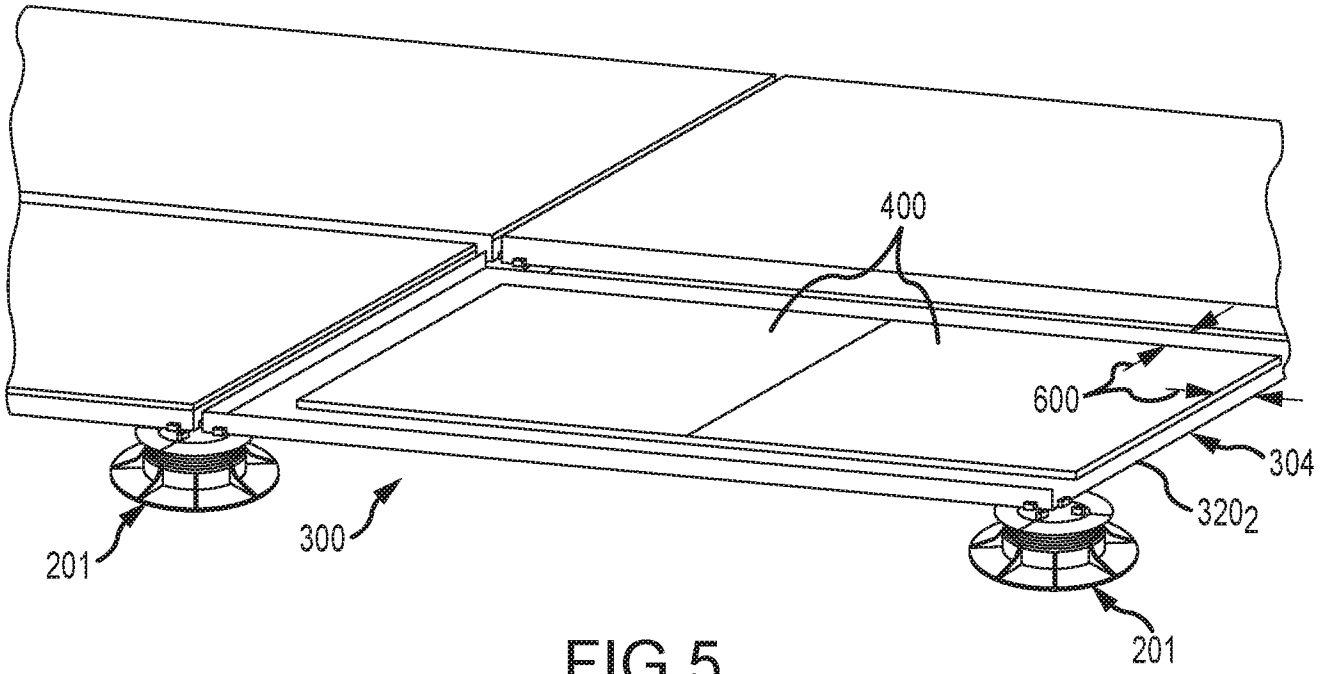
FIG. 5 is similar to FIG. 3 but illustrating one or more strips of adhesive being disposed on an upper surface of the support plate.
Figure 6:
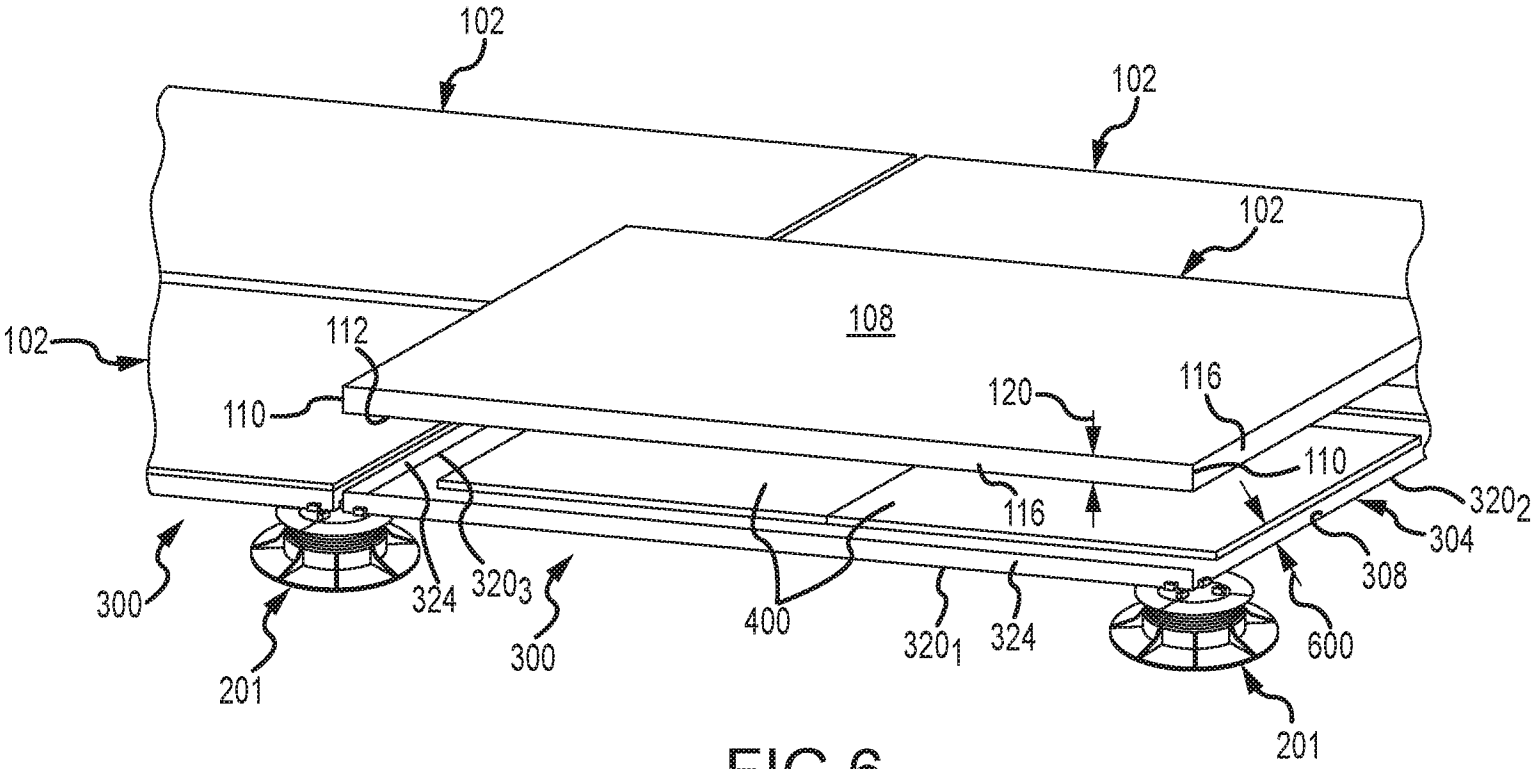
FIG. 6 is similar to FIG. 5 but illustrating a building surface component being positioned over the one or more adhesive strips.

In one arrangement, a gap 600 may be provided on the top surface 308 of the support plate 300 and the bottom surface 112 of the building surface component 102 over which the at least one adhesive is not applied. As shown in FIGS. 5-6, as just one example, the gap 600 may begin at the outer edge segments 320 and extend inwardly towards (but not to) a central portion of the support plate 300. For instance, the gap 600 may extend along at least a portion of one or more of the outer edge segments 320. In one arrangement, the gap 600 may extend along at least a portion of one of the outer edge segments 320 from which locating structures 324 do not extend (e.g., such as the second outer edge segment $\mathbf{320}_2$). This arrangement advantageously allows one or more devices to be disposed between the bottom surface 112 of the building surface component 102 and the top surface 308 of the support plate 300 for purposes of interlocking one or more adjacent components of the elevated building surface assembly 100 to increase the structural stability of the assembly 100. As just one example, one or more restraint splines as disclosed in U.S. Pat. App. Pub. No. 2015/0308126 (incorporated herein by reference in its entirety as if set forth in full) may be disposed between the bottom surface 112 of one building surface component 102 and the top surface 308 of one support plate 300 and between the bottom surface 112 of an adjacent building surface component 102 and the top surface 308 of an adjacent support plate 300 to interlock the adjacent building surface components 102 and limit upward movement of one of the adjacent building surface components 102 relative to the other. In one arrangement, the restraint splines may be secured to the support pedestals 201 in any appropriate manner (e.g., inserting fasteners through the restraint splines and threading the same into the upper surfaces 220 of the support pedestals 201).

Figure 8:
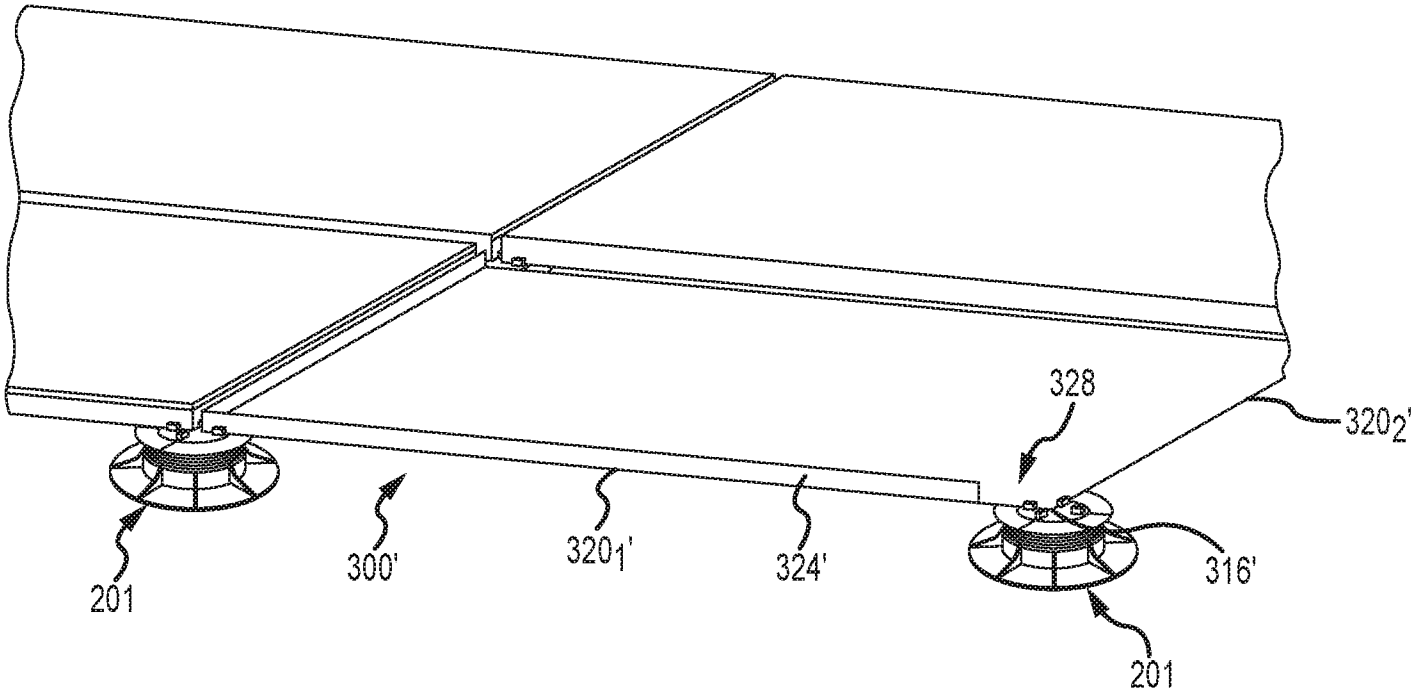
FIG. 8 is similar to FIG. 3 but illustrating another embodiment of the support plate.
Figure 14:
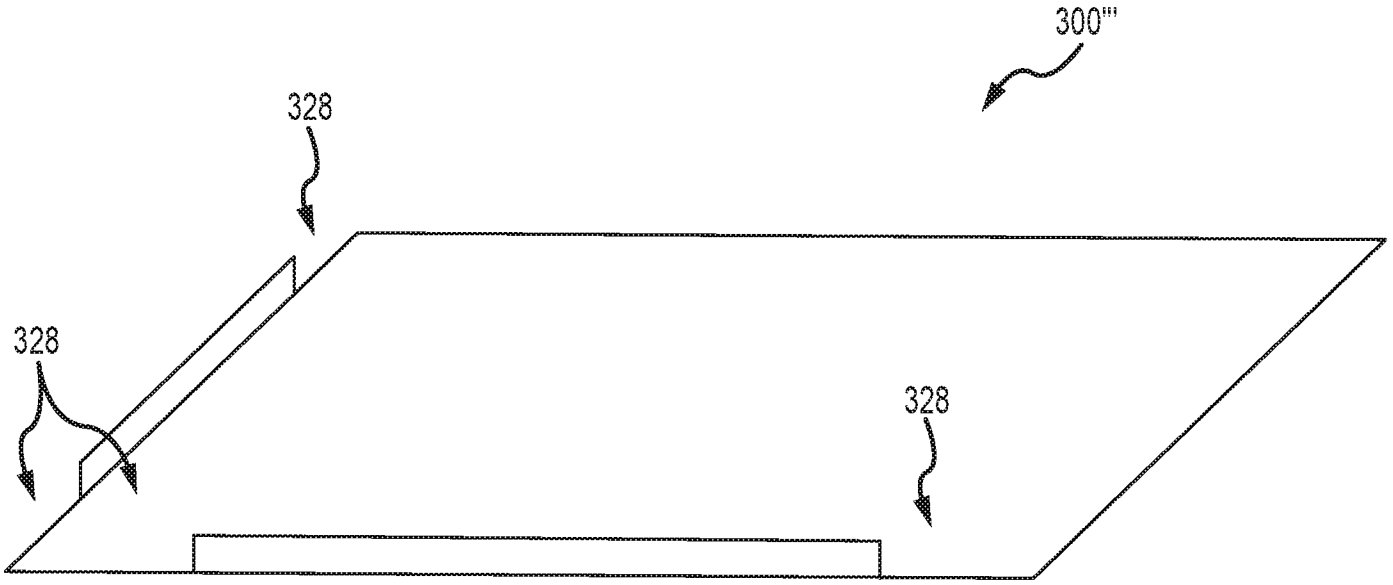
FIG. 14 is a perspective view of another embodiment of the support plate.

As discussed previously, a locating structure 324 need not necessarily extend along an entirety of a particular outer edge segment 320 of a support plate 300. With reference to the support plate 300' of FIG. 8, for instance, the locating structure 324' of the first outer edge segment $\mathbf{320}_1$' may stop short of one or both of the corner portions 316' between which the first outer edge segment $\mathbf{320}_1$' extends to create a space 328 along the first outer edge segment $\mathbf{320}_1$' adjacent the corner portion 316' along which the locating structure 324' does not extend. While not shown in FIG. 8, the first outer edge segment $\mathbf{320}_1$' (e.g., and other outer edge segments 320) may have spaces 328 adjacent both corner portions 316' between which the outer edge segments extend (e.g., see support plate 300''' of FIG. 14).

In any case, the spaces 328 may facilitate attachment of the support plate 300 to the support pedestals 201. As one example, and with reference now to FIG. 9 which is a partial perspective view of one corner 316 of the support plate 300' being disposed over the upper surface 220 of a support pedestal 201 before placement of a building surface component 102 thereover, any appropriate attachment apparatus or system 500 may be positioned into at least a portion of the space 328 and used to secure the support plate 300' to the upper surface 220 of the support pedestal 201. For instance, the attachment system 500 may include a washer 504 with an aperture 512 and a threaded fastener 508 that is sized to be inserted through the aperture 512 and threaded into the upper surface 220 of the support pedestal 201.

Figure 11:
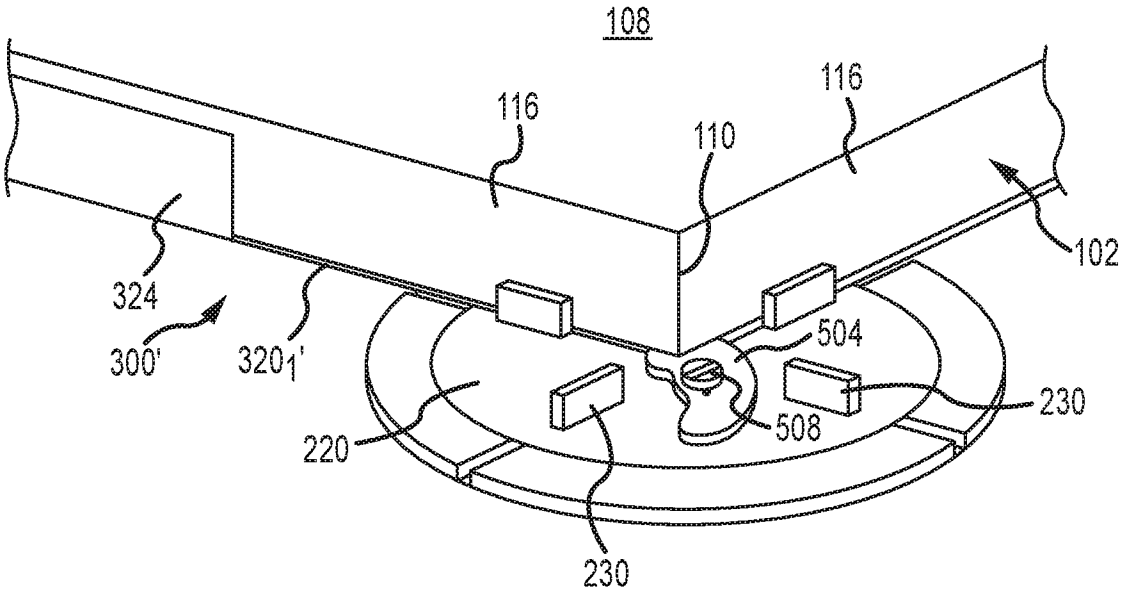
FIG. 11 is similar to FIG. 10 but illustrating a building surface component being disposed on the upper surface of the support plate.

Before placement of a building surface component 102 over the support plate 300 as discussed previously, the washer 504 may be placed over the top surface 308' of the support plate 300 adjacent a corner portion 316' of the support plate 300'. The fastener 508 may then be inserted through the aperture 512 and into the upper surface 220 of the support pedestal 102 until the head (not labeled) of the fastener 508 contacts the washer 512 and clamps the washer 504 against the top surface 308' of the support plate 300' which thus clamps the support plate 300' against the upper surface 220 of the support pedestal 201. See FIG. 10. For instance, the fastener 508 may be a self-tapping fastener that may be inserted through the aperture 512 and threaded into the upper surface 220 of the support pedestal 102. As another example, a pre-formed threaded aperture may be formed in the upper surface 220 of the support pedestal 102 into which the fastener 508 may be threaded. In any event, a building surface component 102 may then be disposed or placed over the upper surface 308 of the support plate 300' as discussed previously. See FIG. 11. In the event that the at least one adhesive 400 or the like is used to bond or secure the building surface component 102 to the support plate 300', use of the attachment system 500 to secure the support plate 300' to the support pedestal 201 also thereby secures the building surface component 102 to the support pedestal 201.

Figure 12:
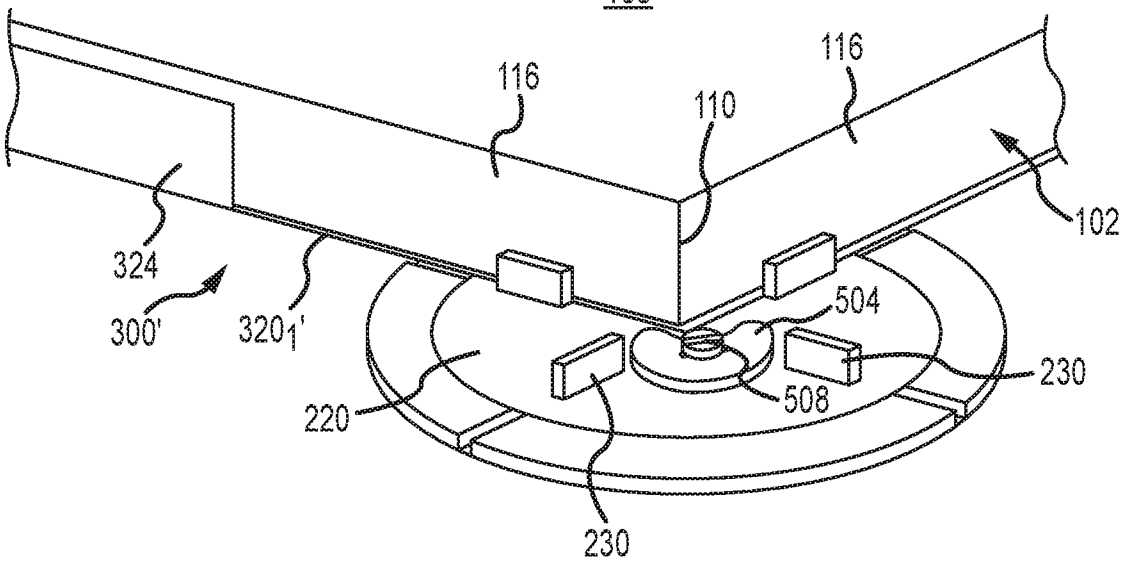
FIG. 12 is similar to FIG. 11 but illustrating an attachment washer being in a different rotational position that allows for removal of the building surface component and support plate from the support pedestal.

In one arrangement, the washer 504 may include a notch 516 therein that may allow for rotation of the washer 504 and alignment of the notch 516 with the support plate 300' (or another support plate 300 disposed over the upper surface 220 of the support pedestal 201) to allow for removal of the support plate 300' and building surface component 102 from the support pedestal 201 without having to first remove any other support plates 300 and building surface components 102 from the upper surface 220 of the support pedestal 201. See FIG. 12. For instance, the washer 504 may be the same as that disclosed in U.S. Pat. No. 8,302,356 which is incorporated herein by reference in its entirety as if set forth in full.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. As one example, while a single building surface component 102 is shown being laid over a single support plate 300 in the figures herein, it is envisioned that two or more building surface components 102 may be laid over and supported on a single support plate 300. As just one simplistic example, the single building surface component 102 shown in FIGS. 6-7 may be replaced by two smaller building surface components 102 (e.g., each being about half the size of the building surface component 102 shown in FIGS. 6-7). In this example, each of such two smaller building surface components 102 would include two corner portions 110 that are disposed over two corner portions 316 of the support plate and two other corner portions that generally abut the two other corner portions of the other smaller building surface component 102 (e.g., where one outer edge segment 116 of each smaller building surface component 102 would abut one outer edge segment 116 of the other smaller building surface component 102 over a central portion of the support plate 300).

Figure 15:
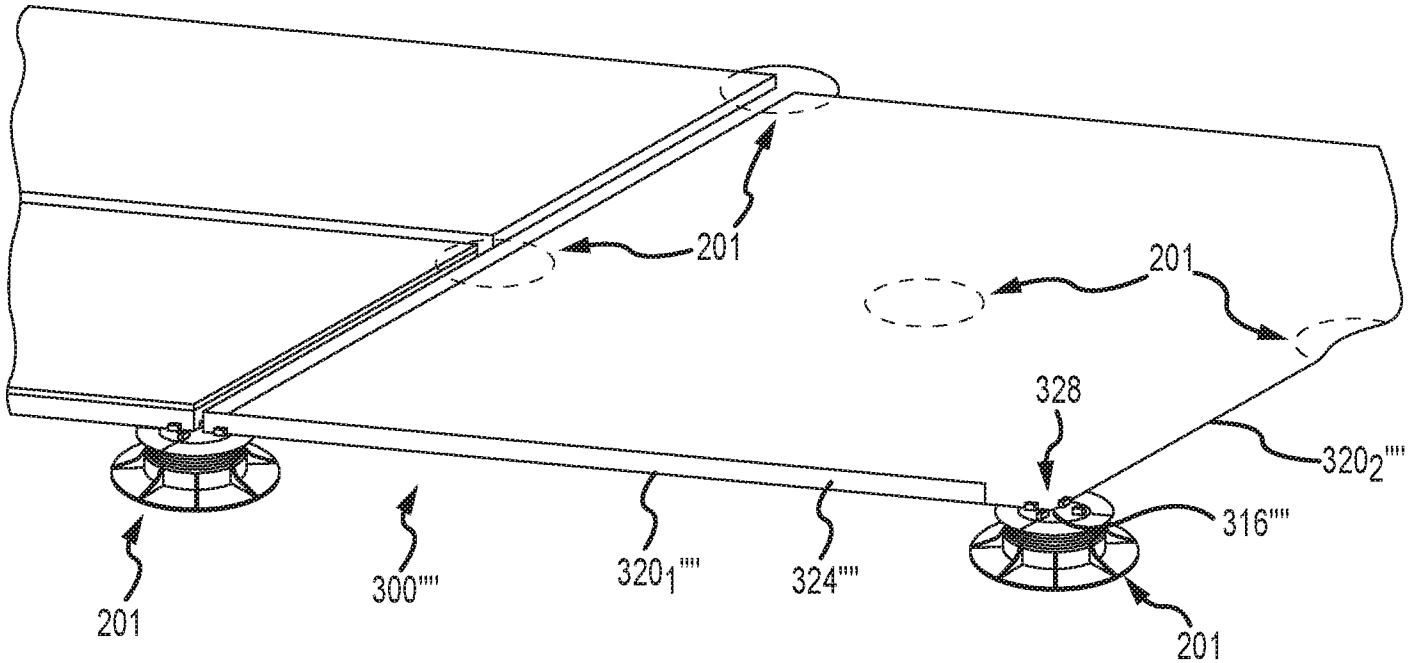
FIG. 15 is a perspective view similar to FIG. 8 but illustrating another embodiment of the support plate.

As another example, not all support plates 300 in a particular elevated building surface assembly 100 need be of the same configuration. For instance, it may be beneficial for some support plates 300 of an elevated building surface assembly 100 to be of the configuration shown in FIGS. 3-7 and for other support plates 300 of the assembly 100 to be of the configuration shown in FIG. 13 (e.g., where the corner portions 316 of the support plates 300 may have spaces 328 as shown in FIGS. 9-12 for securement of the corner portions 316 to support pedestals 201). Furthermore, it is envisioned that at least some support plates 300 of an assembly 100 may extend over at least three or more rows of support pedestals 201. For instance, see support plate 300"" of FIG. 15. In this case, one or more support pedestals 201 may support the support plate 300"" at locations other than the corner portions 316"" of the support plate 300"". For instance, one or more support pedestals 201 may be located at locations along one or more of the outer edge segments 320 that are halfway between the corner portions 316"", one or more support pedestals 201 may be disposed underneath a central portion of the support plate 300"", and/or the like. The support plate 300"" of FIG. 15 may support a single building surface component 102 or two or more building surface components 102.

As a further example, it is not necessary that the spaces 328 are provided on the support plates 300 disclosed herein to allow the support plates 300 to be secured to the support pedestals 201. That is, various other types of attachment apparatuses and systems are envisioned and encompassed herein that may be used to secure the support plates 300 to the support pedestals 201 even if the locating structures 324 extend to the corner portions 316 of the support plates 300. As one simplistic example, fasteners may be inserted through the base 304 and into the upper surfaces 220 of the support pedestals 201 to secure the support plates 300 to the support pedestals 201 (e.g., before the building surface components 102 are placed over the support plates 300).

It is also to be understood that the various components disclosed herein, spaces between adjacent components, etc. are not necessarily drawn to scale. Also, many components have been labeled herein as "first," "second," "third," etc. merely to assist the reader in understanding the relationships between the components and does not imply that an elevated building surface assembly encompassed herein need necessarily have the specific arrangements shown and described herein.

One or more various combinations of the above discussed arrangements and embodiments are also envisioned. While this disclosure contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A method of constructing an elevated flooring surface, comprising:

locating a plurality of support pedestals upon a fixed surface with a predetermined spacing between the support pedestals;

placing support plates over top surfaces of the plurality of support pedestals; wherein each support plate includes a base having a top surface, a bottom surface opposite to the top surface, a plurality of corner portions, a plurality of outer edge segments disposed between adjacent corner portions, a first locating structure attached to a first of the outer edge segments and extending away from the top surface, a second locating structure attached to a second of the outer edge segments and extending away from the top surface; wherein the second outer edge segment is adjacent the first outer edge segment; wherein a first corner portion of the plurality of corner portions is positioned between the first and second outer edge segments; wherein the first and second locating structures extend towards but not to the first corner portion; wherein each support plate includes at least three corner portions that are respectively disposed over the top surfaces of at least three of the support pedestals;

positioning each of a plurality of surface tiles over a respective one of the support plates so that a first of a plurality of outer edge segments of the surface tile abuts the first locating structure of the first outer edge segment of the support plate and so that a second of the plurality of outer edge segments of the surface tile abuts the second locating structure of the second outer edge segment of the support plate, wherein each surface tile includes a top surface, a bottom surface opposite to the top surface, and a plurality of corner portions, wherein each outer edge segment of each support tile is disposed between adjacent corner portions of the surface tile, wherein at least one adhesive secures the bottom surface of each surface tile to the top surface of the one of the support plates, and wherein the top surfaces of the surface tiles collectively form the elevated flooring surface over the fixed surface;

positioning an attachment apparatus into a space between the first and second locating structures over the first corner portion of a first of the support plates; and using the attachment apparatus to secure the first support plate to one of the support pedestals.

2. The method of claim 1, wherein the attachment apparatus includes a threaded fastener, and wherein the using includes:

threading the fastener into the support pedestal.

3. The method of claim 1, further including:

disposing the at least one adhesive onto the top surfaces of the support plates and/or onto the bottom surface of each of the plurality of surface tiles.

4. The method of claim 3, wherein the disposing step occurs after the placing step.

5. The method of claim 3, wherein the at least one adhesive is in a semi-solid or substantially solid state during the disposing step.

6. The method of claim 3, wherein the at least one adhesive is in a fluid state during the disposing step.

7. The method of claim 6, further including allowing the at least one adhesive to solidify into a solid state after the disposing step.

8. The method of claim 7, wherein the at least one adhesive is substantially free of solvents after the step of allowing the at least one adhesive to solidify.

9. The method of claim 1, wherein the at least one adhesive is at least one strip of adhesive.

10. The method of claim 1, wherein the at least one adhesive is inorganic.

11. The method of claim 1, wherein the at least one adhesive is organic.

12. The method of claim 1, wherein a third of the outer edge segments of each support plate is free of locating structures extending away from the top surface.

13. The method of claim 1, wherein each support pedestal includes a base member that rests on the fixed surface, a support member, and a central section that interconnects the base member and support member, wherein the support plates are disposed on top surfaces of the support members of the support pedestals.

14. A method of constructing an elevated flooring surface, comprising:

locating a plurality of support pedestals upon a fixed surface with a predetermined spacing between the support pedestals;

placing support plates over top surfaces of the plurality of support pedestals; wherein each support plate includes a base having a top surface, a bottom surface opposite to the top surface, a plurality of corner portions, a plurality of outer edge segments disposed between adjacent corner portions, a first locating structure attached to a first of the outer edge segments and extending away from the top surface, a second locating structure attached to a second of the outer edge segments and extending away from the top surface; wherein the second outer edge segment is adjacent the first outer edge segment; wherein a first corner portion of the plurality of corner portions is positioned between the first and second outer edge segments; wherein the first and second locating structures extend towards but not to the first corner portion; wherein each support plate includes at least three corner portions that are respectively disposed over the top surfaces of at least three of the support pedestals;

positioning each of a plurality of surface tiles over a respective one of the support plates so that a first of a plurality of outer edge segments of the surface tile abuts the first locating structure of the first outer edge segment of the support plate and so that a second of the plurality of outer edge segments of the surface tile abuts the second locating structure of the second outer edge segment of the support plate, wherein each surface tile includes a top surface, a bottom surface opposite to the top surface, and a plurality of corner portions, wherein each outer edge segment of each support tile is disposed between adjacent corner portions of the surface tile, wherein at least one adhesive secures the bottom surface of each surface tile to the top surface of the one of the support plates, and wherein the top surfaces of the surface tiles collectively form the elevated flooring surface over the fixed surface;

positioning an attachment apparatus into a space between the first and second locating structures over the first corner portion of a first of the support plates; and using the attachment apparatus to secure the first support plate to one of the support pedestals, wherein the attachment apparatus includes a washer, and wherein the positioning includes:

disposing the washer over the top surface of the support plate.

15. A method of constructing an elevated flooring surface, comprising:

locating a plurality of support pedestals upon a fixed surface with a predetermined spacing between the support pedestals;

placing support plates over top surfaces of the plurality of support pedestals; wherein each support plate includes a base having a top surface, a bottom surface opposite to the top surface, a plurality of corner portions, a plurality of outer edge segments disposed between adjacent corner portions, a first locating structure attached to a first of the outer edge segments and extending away from the top surface, a second locating structure attached to a second of the outer edge segments and extending away from the top surface; wherein the second outer edge segment is adjacent the first outer edge segment; wherein a first corner portion of the plurality of corner portions is positioned between the first and second outer edge segments; wherein a gap is disposed over the first corner portion between the first and second locating structures; wherein each support plate includes at least three corner portions that are respectively disposed over the top surfaces of at least three of the support pedestals;

positioning each of a plurality of surface tiles over a respective one of the support plates so that a first of a plurality of outer edge segments of the surface tile abuts the first locating structure of the first outer edge segment of the support plate and so that a second of the plurality of outer edge segments of the surface tile abuts the second locating structure of the second outer edge segment of the support plate, wherein each surface tile includes a top surface, a bottom surface opposite to the top surface, and a plurality of corner portions, wherein each outer edge segment of each support tile is disposed between adjacent corner portions of the surface tile, wherein at least one adhesive secures the bottom surface of each surface tile to the top surface of the one of the support plates, and wherein the top surfaces of the surface tiles collectively form the elevated flooring surface over the fixed surface;

positioning an attachment apparatus into the gap; and using the attachment apparatus to secure the first support plate to one of the support pedestals.

16. The method of claim 15, wherein the attachment apparatus includes a threaded fastener, and wherein the using includes:

threading the fastener into the support pedestal.

17. The method of claim 15, further including:

disposing the at least one adhesive onto the top surfaces of the support plates and/or onto the bottom surface of each of the plurality of surface tiles.

18. The method of claim 15, wherein each support pedestal includes a base member that rests on the fixed surface, a support member, and a central section that interconnects the base member and support member, wherein the support plates are disposed on top surfaces of the support members of the support pedestals.

19. A method of constructing an elevated flooring surface, comprising:

locating a plurality of support pedestals upon a fixed surface with a predetermined spacing between the support pedestals;

placing support plates over top surfaces of the plurality of support pedestals; wherein each support plate includes a base having a top surface, a bottom surface opposite to the top surface, a plurality of corner portions, a plurality of outer edge segments disposed between adjacent corner portions, a first locating structure attached to a first of the outer edge segments and extending away from the top surface, a second locating structure attached to a second of the outer edge segments and extending away from the top surface; wherein the second outer edge segment is adjacent the first outer edge segment; wherein a first corner portion of the plurality of corner portions is positioned between the first and second outer edge segments; wherein a gap is disposed over the first corner portion between the first and second locating structures; wherein each support plate includes at least three corner portions that are respectively disposed over the top surfaces of at least three of the support pedestals;

positioning each of a plurality of surface tiles over a respective one of the support plates so that a first of a plurality of outer edge segments of the surface tile abuts the first locating structure of the first outer edge segment of the support plate and so that a second of the plurality of outer edge segments of the surface tile abuts the second locating structure of the second outer edge segment of the support plate, wherein each surface tile includes a top surface, a bottom surface opposite to the top surface, and a plurality of corner portions, wherein each outer edge segment of each support tile is disposed between adjacent corner portions of the surface tile, wherein at least one adhesive secures the bottom surface of each surface tile to the top surface of the one of the support plates, and wherein the top surfaces of the surface tiles collectively form the elevated flooring surface over the fixed surface;

positioning an attachment apparatus into the gap; and using the attachment apparatus to secure the first support plate to one of the support pedestals, wherein the attachment apparatus includes a washer, and wherein the positioning includes:

disposing the washer over the top surface of the support plate.

* * * * *